United States Patent [19]

von Schuckmann

[11] Patent Number: 4,708,507

[45] Date of Patent: Nov. 24, 1987

[54] DISPENSER WITH FINGER SLOT

[76] Inventor: Alfred von Schuckmann, Kervendonk 63, D-4178 Kevelaer 2, Fed. Rep. of Germany

[21] Appl. No.: 821,482

[22] Filed: Jan. 22, 1986

[30] Foreign Application Priority Data

Jan. 26, 1985 [DE] Fed. Rep. of Germany ..... 3502605

[51] Int. Cl.[4] ..... A47L 23/04; A47L 23/05

[52] U.S. Cl. ..... 401/171; 401/82; 401/176; 401/262

[58] Field of Search ..... 401/82, 176, 171, 262

[56] References Cited

U.S. PATENT DOCUMENTS

| | | | |
|---|---|---|---|
| 1,027,127 | 5/1912 | Harvey | 401/176 |
| 1,512,292 | 10/1924 | McGuire | 401/176 |
| 1,851,322 | 3/1932 | Pears | 401/82 |
| 3,061,084 | 10/1962 | Tibbitts | 401/82 X |
| 3,150,220 | 9/1964 | Howell | 401/262 X |

FOREIGN PATENT DOCUMENTS

| | | | |
|---|---|---|---|
| 2261052 | 6/1974 | Fed. Rep. of Germany | 401/171 |
| 1192948 | 4/1959 | France | 401/176 |
| 493658 | 5/1954 | Italy | 401/176 |

*Primary Examiner*—Steven A. Bratlie

*Attorney, Agent, or Firm*—Wood, Herron & Evans

[57] ABSTRACT

A dispenser for shoe polish is disclosed comprising a cylindrical housing having a closed end and an open end. An applicator is mounted on the closed end and a manually-movable piston is mounted within the housing. The interior of the housing between the piston and the closed end constitutes a material-receiving space, the length of which is substantially equal to the length of the piston. The peripheral wall of the housing includes an axial finger-receiving slot extending inwardly from the open end of the housing for a distance slightly less than the length of the piston.

6 Claims, 3 Drawing Figures

DISPENSER WITH FINGER SLOT

BACKGROUND OF THE INVENTION

This invention relates to a dispenser for shoe polish, or the like, comprising an integrated applicator and contents-receiving space.

It has previously been known to provide a shoe polish dispenser whose contents-receiving space is fashioned to leave as little polish as possible remaining after dispensing. One such dispenser is in the form of a squeeze tube that can be rolled up from its free end. Such a dispenser has the disadvantage that the handle size is being constantly reduced, thereby impeding operability, particularly where it is desirable to aim the material being discharged, e.g., a foam material. Such applicators further include a central passageway which coincides with a passage opening in the container head and which can be sealed by a pin on the lid.

SUMMARY OF THE INVENTION

The problem underlying the invention is to provide a dispenser for shoe polish, or the like, which is simple to manufacture, simple to use, convenient in its operation, and enables the user to aim the material being dispensed.

The present invention is predicated upon the concept of providing a shoe polish dispenser including, in the preferred embodiment, a cylindrical housing which is closed at one end and open at the other. The housing encloses a piston with a transverse inner end wall. The space between this inner end wall of the piston and the closed end of the cylindrical housing constitutes a contents storage space. The length of the piston is substantially equal to the length of this space. The cylindrical housing includes a finger-receiving slot extending from the open end of the housing toward the closed end. The user can eject contents from the dispenser by pressing on the outer end of the piston with a finger which extends through this slot.

One advantage of the present dispenser design is that it provides a means for more conveniently dishcharging a ribbon of polish. The dispenser is easy to hold, i.e., the cylindrical housing which over its entire length is available for piston guidance serves as a handle, fitting ergonomically well in the user's hand. The contents-receiving space within the housing occupies only a portion of its length, i.e., the cylindrical housing section located between the applicator and the piston. Not only the housing surrounding the contents-receiving space, but also the section of the housing surrounding the piston, are available for gripping.

The present dispenser is also advantageous in that it prevents the user from contacting the shoe polish, or other contents, since the piston seals the housing and wipes the guide section of the housing interior clean as the piston is advanced. Operation of the dispenser is rendered much easier due to the fact that the user can reach with his operating finger through the axial slot that extends from the rear opening of the cylindrical housing. The slot edges do not contact the shoe polish or other contents since the piston extends inwardly beyond the inner end of the slot.

The length of the piston equals approximately that of the contents-receiving space, with the axial slot having a slightly lesser length. With such length ratios, the axial slot may even be used as an optical contents-level indicator. The shell wall of the piston preferably includes a snap-on, cup-shaped extension. The sealed bottom of the cup-shaped portion represents the bearing face for the finger of the operator's hand. For conveniently slipping the operating finger in the axial slot without injury, the entrance edges of the axial slot are preferably formed with a convex curvature. This results in a natural centering of the user's finger on the piston end. In a preferred embodiment, the wall at the closed end of the cylindrical housing is chamfered at least circumferentially so that the applicator can be held in the correct position, for instance, by way of bonding, hot-sealing, or the like.

The foregoing objects and advantages of the present invention will be more fully explained hereafter with the aid of a preferred embodiment.

DESCRIPTION OF A PREFERRED EMBODIMENT

The shoe polish dispenser comprises a cylindrical housing 1 for a piston 2 which is axially shiftable within. The cylindrical housing 1 is cup-shaped and, viewed in cross-section, round. Alternatively, a housing of elliptical, or even polygonal, cross-sectional shape may be used as well.

Figure 1:
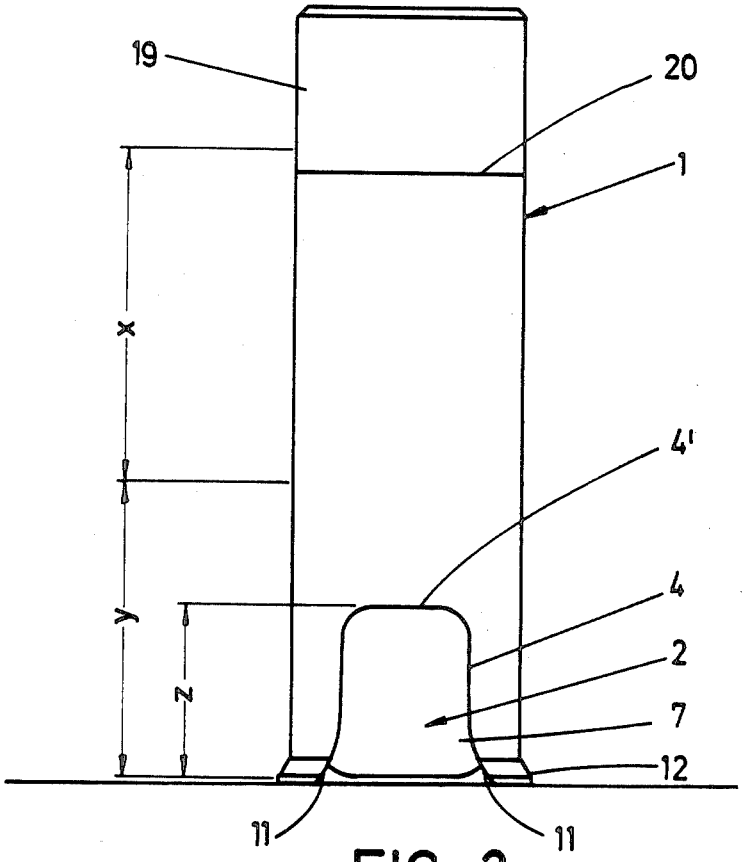
FIG. 1 is a side elevational view of the shoe polish dispenser of the present invention with a cap placed on it.
Figure 2:
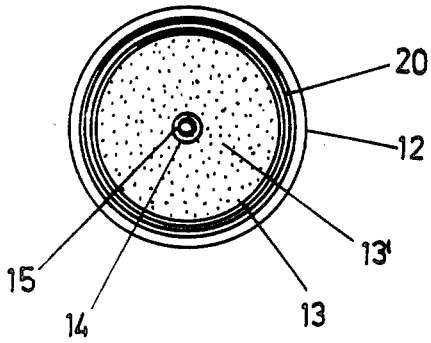
FIG. 2 is a plan view of the shoe polish dispenser with the cap removed.

The area between the piston 2 and the end wall 3 of the cylindrical housing forms the contents-receiving space A for the shoe polish. This intermediate section has a length which essentially equals the length y of the shell wall W of the piston. The length X of space A preferably equals one and one-half times the inside diameter of the cylindrical housing 1. The shell wall W of the piston 2 is disposed in registry with an axial slot 4 (see FIG. 1) originating from the rear opening O of the cylindrical housing 1. The axial slot 4 serves as a passage for the finger of the operator's hand and facilitates advance of the manually-shiftable piston 2. The latter is hollow and sealed both toward the opening O and toward the end wall 3. While the end of piston 2 facing end wall 3 is parallel with that wall, the outer end of the piston is dome-shaped. In the preferred embodiment, piston 2 consists of two cup-shaped components (parts a, b) which are snapped together. Alternatively, part a, i.e., the one forming the push bottom, can comprise a deeper cup having its open end sealed with a disk against which the tip of the operator's finger can press.

To accomplish a clean stripping of the polish from the housing wall and to provide the necessary tight seal, the part of the piston 2 that is marked a includes on its shell wall two annular lips 5 that extend in opposite directions, i.e., upward and downward from a thickened wall section. Between the lip ends, the annular lips 5 extend from the inside face 1' of the cylindrical housing with a slight curvature. The annular lips taper toward their free ends. The juncture of the lips and piston wall from a kerf-type annular fillet 6. Any shoe polish or other material forced into the annular fillet 6 formed adjacent to the innermost lip promotes a sealing contact of said annular lip with the inside face 1'. The other annular lip 5 which faces outwardly supports the piston 2 against slipping downward. Adding to the resistive force provided by this lip is a certain friction effect of the other piston part b whose sheel wall W contacts the inside face 1' of the cylindrical housing 1. Additionally, a certain "sticking" effect of the shoe polish on the inner face of the piston 2 comes into play.

The inner end 4' of the axial slot 4 extends about up to the level of the annular lip 5 facing outwardly toward the opening O, the annular lip being disposed on the upper third of the piston 2.

The length z of the axial shoe 4 equals approximately two-thirds of the length y. The portion of the shell wall of the piston 2, which bears against the cylindrical housing wall, is constituted by part b. This results in a relatively large guided length of the piston since the part b amounts to more than half of the overall length of the piston 2. This part b, which can be described as an extension 7, features on its inside edge a snap groove 8 which is engaged by an annular snap projection 9 of part a. The wall inside of the extension 7 includes inwardly protruding axial ribs 10. The upper end faces of these ribs bear against the edge of the other part a. These ribs thus augment the support provided by groove 8 to prevent the cup-shaped parts a and b from slipping into one another. The axial ribs 10 are preferably disposed at an equal angular spacing relative to one another and thereby function to stiffen part b.

The width of the axial slot 4 corresponds essentially to that of a finger of the operating hand. To eliminate sharp corner edges in the end area of the slot 4 adjacent the open end of the housing, the entrance edges of the slot are of a rounded convex shape. The roundings are identified by the numeral 11. As can be seen clearly from FIG. 1, they result in a slot entrance having a centering effect.

When employing the slot and piston ends as a contents-level indication, the slit length and the length of the contents-receiving space A are scaled relative to one another. A graduation may be provided on the slot edge which interacts with the outer bottom of the piston in the fashion of an index line to indicate the quantity of material remaining in space A.

On the open end of the cylindrical housing 1, a flared stand rim 12 is provided which is preferably of the same wall thickness as the cylindrical housig. This rim also serves as a centering aid for the piston when it is inserted in the housing.

Figure 3:
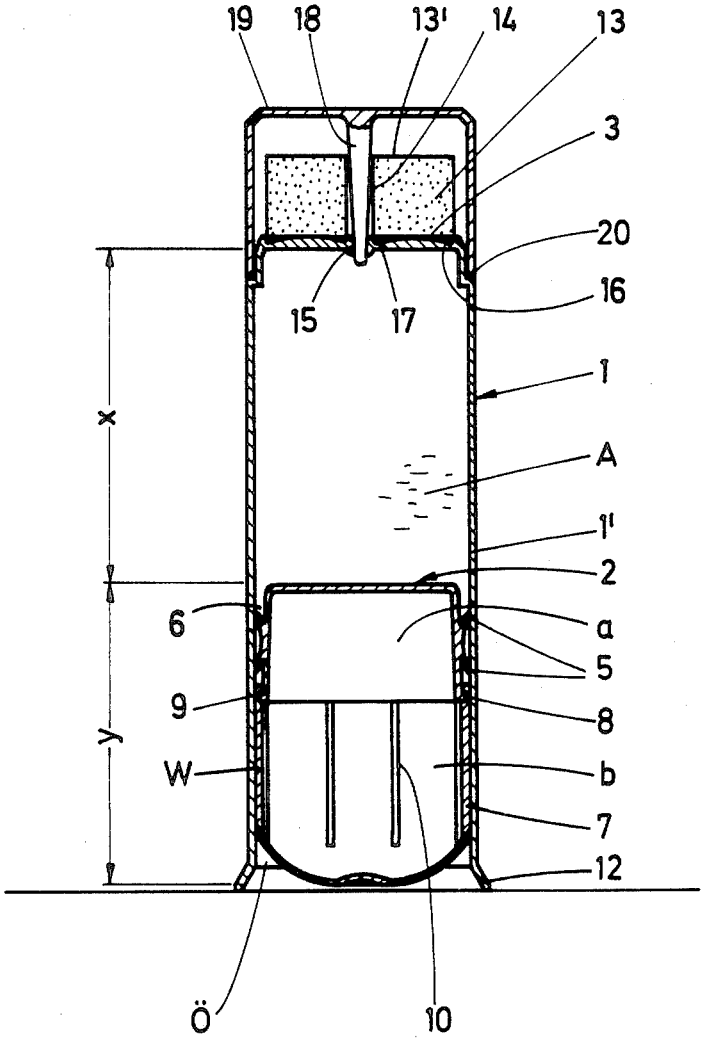
FIG. 3 is a vertical sectional view of the shoe polish dispenser.

A shoe polish applicator 13 is arranged outside the end wall 3. It is a circular disk from open-pore foam material, sponge, etc., which possesses a good absorptivity and the ability to evenly distribute the shoe polish on the surface on which it is applied. The applicator is glued to the outside of the end wall 3 or is affixed to it in some other suitable manner. The applicator includes a central bore 14 which is coaxial with the axis of housing 1. This bore is aligned with the mouthpiece opening 15 formed in the end wall 3 of the cylindrical housing. The mouthpiece opening has a smaller diameter measuring about 2 mm, whereas the diameter of the bore 14 measures about 4–5 mm. The outside of the end wall 3 includes a peripheral rim 16 for engaging the periphery of the applicator 13. A similar rim 17 is provided as well near the mouthpiece opening 15. The aim and purpose of such a design is to give the applicator lateral support. According to FIG. 3, rim 17 is surrounded by a concave annular face. As shown in FIG. 3, the square cross-section of the applicator has not yet been forced into the recess surrounding rim 17, nor bonded to the concave bearing face.

The mouthpiece opening 15 can be sealed by means of a pin 18 provided on a cap 19 which hermetically seals the head of the dispenser, i.e., the applicator, while nesting over it. The pin originates from the top wall of the cap and its free end tapers down to the inside dimension of the mouthpiece opening 15. The cap rim, and the free end of the pin, seal at essentially the same level. The cap rim bears on a shoulder 20 of the cylindrical housing. The shoulder 20 is formed by an inward offset of the cylindrical housing wall.

The cap 19 fits over the end of housing 1 with a frictional fit. To facilitate a centering of the cap on the housing, the end section of the housing over which the cap nests is slightly conical in shape.

Briefly summarized, the dispenser functions as follows: For charging the receiving space A, the cylindrical housing is arranged with the end wall 3 down. The mouthpiece opening 15 is preferably sealed with the aid of the cap. Shoe polish is introduced in a liquid state through the opening O. The piston 2 is next inserted in place. To avoid trapping, air is allowed to escape through roughing the inside face 1' in the area engaged by the piston.

In use, the cap 19 is removed and the piston advanced toward the mouthpiece opening with a finger of the operator's hand. The shoe polish advances thereby into the bore 14 and also slightly above it as a central bead across the flat spreading surface 13'. The dispensation is completely independent of position of the dispenser. The polish is spread on the uppers of the shoes with the entire cylindrical body being grasped in the hand as a well-manageable tool.

From the above disclosure of the general principles of the present invention and the preceding detailed description of a preferred embodiment, those skilled in the art will readily comprehend the various modifications to which the present invention is susceptible. Therefore, I desired to be limited only by the scope of the following claims.

Having described my invention, I claim:

1. A dispenser for dispensing shoe polish, said dispenser comprising:

a cylindrical housing having a peripheral wall, an end wall and an open end;

an applicator mounted on the end wall of said cylindrical housing;

a manually-movable piston mounted within said housing, said piston comprising a peripheral shell wall, and a transverse end wall;

the interior of said housing intermediate said housing end wall and said transverse end wall of said piston comprising a material-receiving space;

the length of said piston being substantially equal to the length of the contents-receiving space when said piston is in its retractable position;

said peripheral wall of said housing having an axial finger-receiving slot extending inwardly from said open end toward said housing end wall.

2. The dispenser of claim 1 in which said piston comprises a first member carrying said transverse end wall and in which said peripheral shell wall comprises a portion of a cup-shaped member, said cup-shaped member and said first member being connected by a snap-on connection.

3. The dispenser of claim 1 in which the outermost portion of said axial slot is rounded in a convex configuration.

4. The dispenser of claim 1 in which the length of said slot is less than the length of said piston.

5. The dispenser of claim 4 in which in said retracted position of said piston the outermost end thereof is disposed adjacent to the open end of said housing.

6. The dispenser of claim 1 further comprising means carried by said piston for sealingly engaging the peripheral wall of said housing intermediate said slot and the end wall of said housing when said piston is in said retracted position.

* * * * *